US010179886B2

(12) United States Patent
Campbell et al.

(10) Patent No.: US 10,179,886 B2
(45) Date of Patent: Jan. 15, 2019

(54) SYNERGISTIC DISPERSANTS

(71) Applicant: Afton Chemical Corporation, Richmond, VA (US)

(72) Inventors: Diane Campbell, Chesterfield, VA (US); Jason Lagona, Richmond, VA (US)

(73) Assignee: AFTON CHEMICAL CORPORATION, Richmond, VA (US)

( * ) Notice: Subject to any disclaimer, the term of this patent is extended or adjusted under 35 U.S.C. 154(b) by 5 days.

(21) Appl. No.: 15/156,372

(22) Filed: May 17, 2016

(65) Prior Publication Data

US 2017/0335228 A1 Nov. 23, 2017

(51) Int. Cl.

| | |
|---|---|
| ***C10M 133/00*** | (2006.01) |
| ***C10M 133/52*** | (2006.01) |
| ***C10M 161/00*** | (2006.01) |
| ***C10M 159/12*** | (2006.01) |
| *C10N 20/04* | (2006.01) |
| *C10N 30/04* | (2006.01) |

(52) U.S. Cl.

CPC ..... *C10M 159/12* (2013.01); *C10M 133/00* (2013.01); *C10M 133/52* (2013.01); *C10M 161/00* (2013.01); *C10M 2207/123* (2013.01); *C10M 2207/129* (2013.01); *C10M 2207/142* (2013.01); *C10M 2207/16* (2013.01); *C10M 2215/04* (2013.01); *C10M 2215/28* (2013.01); *C10M 2223/045* (2013.01); *C10N 2020/04* (2013.01); *C10N 2030/04* (2013.01); *C10N 2220/021* (2013.01); *C10N 2220/12* (2013.01); *C10N 2230/04* (2013.01); *C10N 2230/041* (2013.01); *C10N 2230/50* (2013.01); *C10N 2230/54* (2013.01); *C10N 2230/74* (2013.01); *C10N 2240/10* (2013.01); *C10N 2240/101* (2013.01); *C10N 2240/102* (2013.01); *C10N 2240/103* (2013.01); *C10N 2240/104* (2013.01); *C10N 2260/00* (2013.01)

(58) Field of Classification Search

CPC combination set(s) only.
See application file for complete search history.

(56) References Cited

U.S. PATENT DOCUMENTS

| | | | |
|---|---|---|---|
| 3,219,666 | A | 11/1965 | Norman et al. |
| 3,565,804 | A | 2/1971 | Honnen et al. |
| 3,634,515 | A | 1/1972 | Piasek et al. |
| 3,697,574 | A | 10/1972 | Piasek et al. |
| 3,736,357 | A | 5/1973 | Piasek et al. |
| 4,152,499 | A | 5/1979 | Boerzel et al. |
| 4,234,435 | A | 11/1980 | Meinhardt et al. |
| 4,259,194 | A | 3/1981 | deVries et al. |
| 4,259,195 | A | 3/1981 | King et al. |
| 4,261,843 | A | 4/1981 | King et al. |
| 4,262,152 | A | 4/1981 | King et al. |
| 4,265,773 | A | 5/1981 | deVries et al. |
| 4,272,387 | A | 6/1981 | King et al. |
| 4,283,295 | A | 8/1981 | deVries et al. |
| 4,285,822 | A | 8/1981 | deVries et al. |
| 4,636,322 | A | 1/1987 | Nalesnik |
| 5,241,003 | A | 8/1993 | Degonia et al. |
| 5,334,321 | A | 8/1994 | Harrison et al. |
| 5,336,041 | A | 8/1994 | Seidel et al. |
| 5,627,259 | A | 5/1997 | Thaler et al. |
| 5,633,326 | A | 5/1997 | Patil et al. |
| 5,643,859 | A | 7/1997 | Gutierrez et al. |
| 5,650,381 | A | 7/1997 | Gatto et al. |
| 5,739,355 | A | 4/1998 | Gateau et al. |
| 5,792,729 | A | 8/1998 | Harrison et al. |
| 5,851,965 | A | 12/1998 | Harrison et al. |
| 5,853,434 | A | 12/1998 | Harrison et al. |
| 5,883,057 | A | 3/1999 | Roell, Jr. et al. |
| RE37,363 | E | 9/2001 | Gatto et al. |
| 6,300,291 | B1 | 10/2001 | Hartley et al. |

(Continued)

FOREIGN PATENT DOCUMENTS

| | | | |
|---|---|---|---|
| EP | 170891 | B1 | 1/1989 |
| EP | 0612839 | A1 | 8/1994 |
| EP | 2557144 | A1 | 2/2013 |
| EP | 2562238 | A1 | 2/2013 |
| EP | 2915871 | A1 | 9/2015 |
| EP | 2949738 | A1 | 12/2015 |
| JP | 2008127435 | A | 6/2008 |
| WO | WO9406897 | A1 | 3/1994 |
| WO | WO2009132250 | A2 | 10/2009 |

OTHER PUBLICATIONS

European Search Report; dated Sep. 18, 2017 for EP Application No. EP17166962.5.

*Primary Examiner* — Prem C Singh
*Assistant Examiner* — Chantel L Graham
(74) *Attorney, Agent, or Firm* — Mendelsohn Dunleavy, P.C.

(57) ABSTRACT

Lubricant compositions including an additive composition and methods for its use in engines that produce soot. The lubricant composition contains a base oil and an additive composition having (a) at least 0.05 percent by weight of a first dispersant that is a reaction product of A) a hydrocarbyl-dicarboxylic acid or anhydride, and B) at least one polyamine; and (b) at least 0.05 percent by weight, both based on a total weight of the lubricant composition, of a second dispersant that is a reaction product of A') a hydrocarbyl-dicarboxylic acid or anhydride, and B') at least one polyamine, wherein the reaction product is post-treated with C) an aromatic carboxylic acid, an aromatic polycarboxylic acid, or an aromatic anhydride wherein all carboxylic acid or anhydride groups are attached directly to an aromatic ring, and/or D) a non-aromatic dicarboxylic acid or anhydride having a number average molecular weight of less than about 500.

17 Claims, 1 Drawing Sheet

(56) References Cited

U.S. PATENT DOCUMENTS

| | | | | |
|---|---|---|---|---|
| 6,548,458 | B2 | 4/2003 | Loper | |
| 6,723,685 | B2 | 4/2004 | Hartley et al. | |
| RE38,929 | E | 1/2006 | Gatto et al. | |
| 7,214,649 | B2 | 5/2007 | Loper et al. | |
| RE40,595 | E | 12/2008 | Gatto et al. | |
| 7,645,726 | B2 | 1/2010 | Loper | |
| 7,732,390 | B2 | 6/2010 | Kadkhodayan et al. | |
| 7,897,696 | B2 | 3/2011 | Huang et al. | |
| 8,048,831 | B2 | 11/2011 | Loper | |
| 8,927,469 | B2 | 1/2015 | Mathur et al. | |
| 2004/0048753 | A1* | 3/2004 | Ritchie | C10M 141/06 508/232 |
| 2008/0027181 | A1* | 1/2008 | Loper | C08F 220/18 525/330.3 |
| 2008/0282607 | A1* | 11/2008 | Dietz | C10L 1/14 44/387 |
| 2010/0160192 | A1 | 6/2010 | Ruhe, Jr. | |
| 2010/0160194 | A1* | 6/2010 | Harrison | C08F 8/32 508/290 |
| 2012/0101017 | A1 | 4/2012 | Duggal | |

* cited by examiner

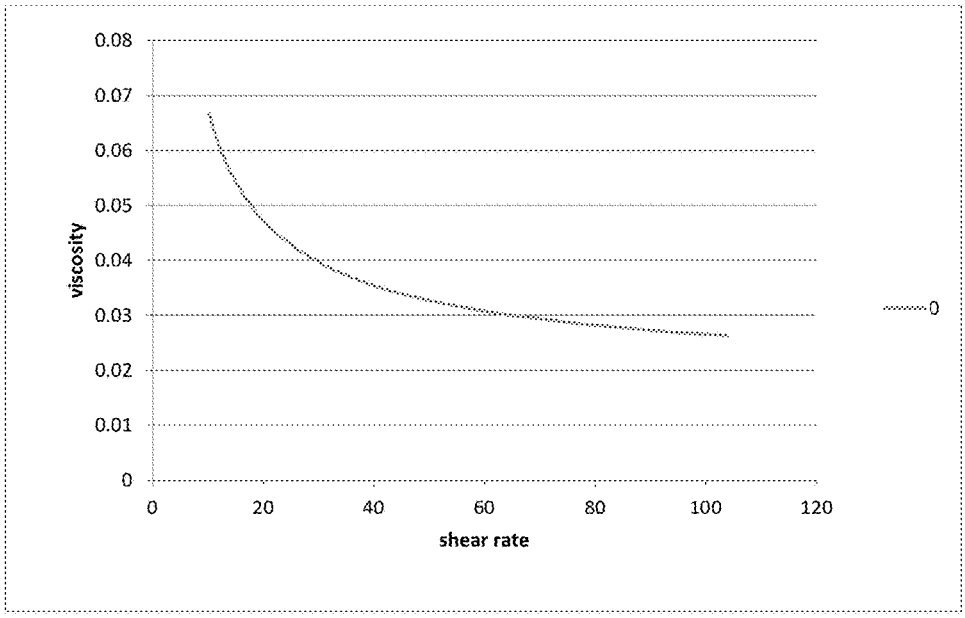
0.08
0.07
0.06
0.05
0.04
0.03
0.02
0.01
0
viscosity
0
20
40
60
80
100
120
shear rate
0

SYNERGISTIC DISPERSANTS

TECHNICAL FIELD

The disclosure relates to lubricant compositions and in particular to additive compositions for improving or maintaining the soot or sludge handling characteristics of an engine lubricant composition, while minimizing the treat rate of the dispersants in the lubricant composition.

BACKGROUND

Engine lubricant compositions may be selected to provide increased engine protection, as well as an increase in fuel economy, and a reduction in emissions. However, in order to achieve benefits of improved fuel economy and reduced emissions, a balance between engine protection and lubricating properties is required for the lubricant composition. For example, an increase in the amount of friction modifiers may be beneficial for fuel economy purposes but may lead to reduced ability of the lubricant composition to handle water. Likewise, an increase in the amount of anti-wear agent in the lubricant may provide improved engine protection against wear but may be detrimental to catalyst performance for reducing emissions.

The same is true for the soot and sludge handling components of a lubricant composition. Dispersants are added to lubricant compositions to keep the soot and sludge in suspension and prevent the contaminants from settling on and/or adhering to surfaces. As the amount of dispersant(s) in a lubricant composition is increased, typically, the soot and sludge handling properties of the lubricant are improved. For use with heavy duty diesel engines, the treat rates for a dispersant to be effective are very high. However, high dispersant treat rates increase corrosion and are harmful to seals. Accordingly, there is a need for dispersants, or a dispersant combination that can provide satisfactory soot handling properties to the lubricant composition using a relatively lower treat rate of the dispersant. Such lubricant compositions should be suitable for meeting or exceeding currently proposed and future lubricant performance standards.

SUMMARY AND TERMS

In a first aspect, the present disclosure relates to a lubricant composition including 50% to 99% by weight of a base oil, based on the total weight of the lubricant composition, and an additive composition including at least 0.05 percent by weight, based on a total weight of the lubricant composition, of a first dispersant that is a reaction product of A) a hydrocarbyl-dicarboxylic acid or anhydride, and B) at least one polyamine; and at least 0.05 percent by weight, based on a total weight of the lubricant composition, of a second dispersant that is a reaction product of A') a hydrocarbyl-dicarboxylic acid or anhydride, and B') at least one polyamine, and wherein the reaction product is post-treated with C) an aromatic carboxylic acid, an aromatic polycarboxylic acid, or an aromatic anhydride wherein all carboxylic acid or anhydride groups are attached directly to an aromatic ring, and/or D) a non-aromatic dicarboxylic acid or anhydride having a number average molecular weight of less than about 500.

In a preferred embodiment the hydrocarbyl dicarboxylic acid or anhydride A' comprises a polyisobutenyl succinic acid or anhydride.

In each of the foregoing embodiments the second dispersant may be a reaction product of A' and B' that is post-treated with both C and D. Alternatively, the reaction product of the second dispersant may preferably be post-treated only with D, and in a further preferred alternative the second dispersant may be post-treated only with C. In such embodiments C preferably comprises 1,8-naphthalic anhydride, and D preferably comprises maleic anhydride.

In each of the foregoing embodiments of the lubricant composition, the hydrocarbyl dicarboxylic acids or anhydrides A and A' may each comprise a polyisobutenyl succinic acid or anhydride.

In all of the foregoing embodiments, the additive composition may also comprise a third dispersant that is different from the first and second dispersants. Preferably, the third dispersant may be a polyisobutenyl succinic acid or anhydride, or the third dispersant may be a reaction product of A') a hydrocarbyl-dicarboxylic acid or anhydride, and B') at least one polyamine, wherein the reaction product is post-treated with C) an aromatic carboxylic acid, an aromatic polycarboxylic acid, or an aromatic anhydride wherein all carboxylic acid or anhydride groups are attached directly to an aromatic ring, and/or D) a non-aromatic dicarboxylic acid or anhydride having a number average molecular weight of less than about 500. More preferably, the third dispersant is a reaction product of A') a hydrocarbyl-dicarboxylic acid or anhydride, and B') at least one polyamine wherein the reaction product is post-treated with a non-aromatic dicarboxylic acid or anhydride having a number average molecular weight of less than about 500.

In all of the foregoing embodiments, the lubricant or additive composition may further comprise one or more of detergents, dispersants, friction modifiers, antioxidants, rust inhibitors, viscosity index improvers, emulsifiers, demulsifiers, corrosion inhibitors, antiwear agents, metal dihydrocarbyl dithiophosphates, ash-free amine phosphate salts, antifoam agents, and pour point depressants and any combination thereof.

In all of the foregoing embodiments the lubricant composition may comprise at least 1.5 wt. % soot up to about 8 wt. % soot. More preferably the lubricant composition may comprise from about 2 wt. % to about 3 wt. % soot.

In all of the foregoing embodiments, the lubricant composition may have a Noack volatility of less than 15 mass %, or, more preferably, the lubricant composition may have a Noack volatility of less than 13 mass %.

In further embodiments the invention relates to a method for lubricating an engine by lubricating an engine with a lubricant composition of any of the forgoing embodiments.

In yet another embodiment, the invention relates to a method for maintaining the soot or sludge handling capability of an engine lubricant composition comprising the step of adding to the engine lubricant composition an additive composition as described in any of the foregoing embodiments.

In yet a further embodiment, the invention relates to the use of a lubricating composition according to any of the forgoing embodiments to lubricate an engine.

In a further embodiment the invention relates to the use of an additive composition as described in any of the foregoing embodiments to maintain the soot or sludge handling capability of a lubricant composition.

The following definitions of terms are provided in order to clarify the meanings of certain terms as used herein.

The terms "oil composition," "lubrication composition," "lubricating oil composition," "lubricating oil," "lubricant composition," "lubricating composition," "fully formulated lubricant composition," "lubricant," "crankcase oil," "crankcase lubricant," "engine oil," "engine lubricant," "motor oil," and "motor lubricant" are considered synonymous, fully interchangeable terminology referring to the finished lubrication product comprising a major amount of a base oil plus a minor amount of an additive composition.

As used herein, the terms "additive package," "additive concentrate," "additive composition," "engine oil additive package," "engine oil additive concentrate," "crankcase additive package," "crankcase additive concentrate," "motor oil additive package," "motor oil concentrate," are considered synonymous, fully interchangeable terminology referring the portion of the lubricating oil composition excluding the major amount of base oil stock mixture. The additive package may or may not include the viscosity index improver or pour point depressant.

The term "overbased" relates to metal salts, such as metal salts of sulfonates, carboxylates, salicylates, and/or phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, salicylates, and/or phenols.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(a) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic moiety);

(b) substituted hydrocarbon substituents, that is, substituents containing non-hydrocarbon groups which, in the context of this disclosure, do not alter the predominantly hydrocarbon substituent (e.g., halo (especially chloro and fluoro), hydroxy, alkoxy, mercapto, alkylmercapto, nitro, nitroso, amino, alkylamino, and sulfoxy); and (c) hetero substituents, that is, substituents which, while having a predominantly hydrocarbon character, in the context of this disclosure, contain other than carbon in a ring or chain otherwise composed of carbon atoms. Heteroatoms may include sulfur, oxygen, and nitrogen, and encompass substituents such as pyridyl, furyl, thienyl, and imidazolyl. In general, no more than two, for example, no more than one, non-hydrocarbon substituent will be present for every ten carbon atoms in the hydrocarbyl group; typically, there will be no non-hydrocarbon substituents in the hydrocarbyl group.

As used herein, the term "percent by weight", unless expressly stated otherwise, means the percentage the recited component represents to the weight of the entire composition.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "TBN" as employed herein is used to denote the Total Base Number in mg KOH/g as measured by the method of ASTM D2896 or ASTM D4739 or DIN 51639-1.

The term "alkyl" as employed herein refers to straight, branched, cyclic, and/or substituted saturated chain moieties of from about 1 to about 100 carbon atoms.

The term "alkenyl" as employed herein refers to straight, branched, cyclic, and/or substituted unsaturated chain moieties of from about 3 to about 10 carbon atoms.

The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, oxygen, and sulfur.

Lubricants, combinations of components, or individual components of the present description may be suitable for use in various types of internal combustion engines. Suitable engine types may include, but are not limited to heavy duty diesel, passenger car, light duty diesel, medium speed diesel, or marine engines. An internal combustion engine may be a diesel fueled engine, a gasoline fueled engine, a natural gas fueled engine, a bio-fueled engine, a mixed diesel/biofuel fueled engine, a mixed gasoline/biofuel fueled engine, an alcohol fueled engine, a mixed gasoline/alcohol fueled engine, a compressed natural gas (CNG) fueled engine, or mixtures thereof. A diesel engine may be a compression ignited engine. A gasoline engine may be a spark-ignited engine. An internal combustion engine may also be used in combination with an electrical or battery source of power. An engine so configured is commonly known as a hybrid engine. The internal combustion engine may be a 2-stroke, 4-stroke, or rotary engine. Suitable internal combustion engines include marine diesel engines (such as inland marine), aviation piston engines, low-load diesel engines, and motorcycle, automobile, locomotive, and truck engines. Particularly preferred types of engines for which the lubricant compositions of the present invention may be used are heavy duty diesel (HDD) engines.

HDD engines are commonly known to produce soot levels in lubricants in the range of about 2% to about 3%. Additionally, in older model HDD engines the soot level could reach levels of up to about 8%. Additionally, gasoline direct injection (GDi) engines also suffer from soot in their lubricating fluids. A test of a GDi engine using the Ford Chain Wear Test run for 312 hours produced a soot level of 2.387% in the lubricant. Depending on the manufacturer and operating conditions the soot levels in direct fuel injection gasoline engines can be in the range of about 1.5% to about 3%. For comparison a non-direct injection gasoline engine was also tested to determine the soot amounts produced in the lubricant. The results of this test showed only about 1.152% soot in the lubricant.

Based on the higher levels of soot produced by HDD and GDi engines, the present synergistic dispersants are preferred for use with these types of engines. For use in HDD engines and direct fuel injected gasoline engines the soot present in the oil can range from about 0.05% to about 8% depending on the age, manufacturer, and operating conditions of the engine. In some embodiments, the soot level in the lubricating composition is greater than about 1.5%, or preferably the soot level is from about 1.5% to about 8%, and most preferably the soot level in the lubricating fluid is from about 2% to about 3%.

The internal combustion engine may contain components of one or more of an aluminum-alloy, lead, tin, copper, cast iron, magnesium, ceramics, stainless steel, composites, and/or mixtures thereof. The components may be coated, for example, with a diamond-like carbon coating, a lubricated coating, a phosphorus-containing coating, molybdenum-containing coating, a graphite coating, a nano-particle-containing coating, and/or mixtures thereof. The aluminum-alloy may include aluminum silicates, aluminum oxides, or other ceramic materials. In one embodiment the aluminum-alloy is an aluminum-silicate surface. As used herein, the term "aluminum alloy" is intended to be synonymous with "aluminum composite" and to describe a component or surface comprising aluminum and another component intermixed or reacted on a microscopic or nearly microscopic level, regardless of the detailed structure thereof. This would include any conventional alloys with metals other than aluminum as well as composite or alloy-like structures with non-metallic elements or compounds such with ceramic-like materials.

The lubricating oil composition for an internal combustion engine may be suitable for any engine lubricant irrespective of the sulfur, phosphorus, or sulfated ash (ASTM D-874) content. The sulfur content of the engine oil lubricant may be about 1 wt % or less, or about 0.8 wt % or less, or about 0.5 wt % or less, or about 0.3 wt % or less, or about 0.2 wt % or less. In one embodiment the sulfur content may be in the range of about 0.001 wt % to about 0.5 wt %, or about 0.01 wt % to about 0.3 wt %. The phosphorus content may be about 0.2 wt % or less, or about 0.1 wt % or less, or about 0.085 wt % or less, or about 0.08 wt % or less, or even about 0.06 wt % or less, about 0.055 wt % or less, or about 0.05 wt % or less. In one embodiment the phosphorus content may be about 50 ppm to about 1000 ppm, or about 325 ppm to about 850 ppm. The total sulfated ash content may be about 2 wt % or less, or about 1.5 wt % or less, or about 1.1 wt % or less, or about 1 wt % or less, or about 0.8 wt % or less, or about 0.5 wt % or less. In one embodiment the sulfated ash content may be about 0.05 wt % to about 0.9 wt %, or about 0.1 wt % or about 0.2 wt % to about 0.45 wt %. In another embodiment, the sulfur content may be about 0.4 wt % or less, the phosphorus content may be about 0.08 wt % or less, and the sulfated ash is about 1 wt % or less. In yet another embodiment the sulfur content may be about 0.3 wt % or less, the phosphorus content is about 0.05 wt % or less, and the sulfated ash may be about 0.8 wt % or less.

In one embodiment the lubricating oil composition is an engine oil, wherein the lubricating oil composition may have (i) a sulfur content of about 0.5 wt % or less, (ii) a phosphorus content of about 0.1 wt % or less, and (iii) a sulfated ash content of about 1.5 wt % or less.

In one embodiment the lubricating oil composition is suitable for a 2-stroke or a 4-stroke marine diesel internal combustion engine. In one embodiment the marine diesel combustion engine is a 2-stroke engine. In some embodiments, the lubricating oil composition is not suitable for a 2-stroke or a 4-stroke marine diesel internal combustion engine for one or more reasons, including but not limited to, the high sulfur content of fuel used in powering a marine engine and the high TBN required for a marine-suitable engine oil (e.g., above about 40 TBN in a marine-suitable engine oil).

In some embodiments, the lubricating oil composition is suitable for use with engines powered by low sulfur fuels, such as fuels containing about 1 to about 5% sulfur. Highway vehicle fuels contain about 15 ppm sulfur (or about 0.0015% sulfur).

Low speed diesel typically refers to marine engines, medium speed diesel typically refers to locomotives, and high speed diesel typically refers to highway vehicles. The lubricating oil composition may be suitable for only one of these types or all.

Further, lubricants of the present description may be suitable to meet one or more industry specification requirements such as ILSAC GF-3, GF-4, GF-5, GF-6, CK-4, FA-4, CJ-4, CI-4 Plus, CI-4, ACEA A1/B1, A2/B2, A3/B3, A3/B4, A5/B5, C1, C2, C3, C4, C5, E4/E6/E7/E9, Euro 5/6, JASO DL-1, Low SAPS, Mid SAPS, or original equipment manufacturer specifications such as Dexos™ 1, Dexos™ 2, MB-Approval 229.51/229.31, VW 502.00, 503.00/503.01, 504.00, 505.00, 506.00/506.01, 507.00, 508.00, 509.00, BMW Longlife-04, Porsche C30, Peugeot Citroën Automobiles B71 2290, B71 2296, B71 2297, B71 2300, B71 2302, B71 2312, B71 2007, B71 2008, Ford WSS-M2C153-H, WSS-M2C930-A, WSS-M2C945-A, WSS-M2C913A, WSS-M2C913-B, WSS-M2C913-C, GM 6094-M, Chrysler MS-6395, or any past or future PCMO or HDD specifications not mentioned herein. In some embodiments for passenger car motor oil (PCMO) applications, the amount of phosphorus in the finished fluid is 1000 ppm or less or 900 ppm or less or 800 ppm or less.

Other hardware may not be suitable for use with the disclosed lubricant. A "functional fluid" is a term which encompasses a variety of fluids including but not limited to tractor hydraulic fluids, power transmission fluids including automatic transmission fluids, continuously variable transmission fluids and manual transmission fluids, hydraulic fluids, including tractor hydraulic fluids, some gear oils, power steering fluids, fluids used in wind turbines, compressors, some industrial fluids, and fluids related to power train components. It should be noted that within each of these fluids such as, for example, automatic transmission fluids, there are a variety of different types of fluids due to the various transmissions having different designs which have led to the need for fluids of markedly different functional characteristics. This is contrasted by the term "lubricating fluid" which is not used to generate or transfer power.

With respect to tractor hydraulic fluids, for example, these fluids are all-purpose products used for all lubricant applications in a tractor except for lubricating the engine. These lubricating applications may include lubrication of gearboxes, power take-off and clutch(es), rear axles, reduction gears, wet brakes, and hydraulic accessories.

When the functional fluid is an automatic transmission fluid, the automatic transmission fluids must have enough friction for the clutch plates to transfer power. However, the friction coefficient of fluids has a tendency to decline due to the temperature effects as the fluid heats up during operation. It is important that the tractor hydraulic fluid or automatic transmission fluid maintain its high friction coefficient at elevated temperatures, otherwise brake systems or automatic transmissions may fail. This is not a function of an engine oil.

Tractor fluids, and for example Super Tractor Universal Oils (STUOs) or Universal Tractor Transmission Oils (UTTOs), may combine the performance of engine oils with transmissions, differentials, final-drive planetary gears, wet-brakes, and hydraulic performance. While many of the additives used to formulate a UTTO or a STUO fluid are similar in functionality, they may have deleterious effect if not incorporated properly. For example, some anti-wear and extreme pressure additives used in engine oils can be extremely corrosive to the copper components in hydraulic pumps. Detergents and dispersants used for gasoline or diesel engine performance may be detrimental to wet brake performance. Friction modifiers specific to quiet wet brake noise, may lack the thermal stability required for engine oil performance. Each of these fluids, whether functional, tractor, or lubricating, are designed to meet specific and stringent manufacturer requirements.

Engine oils of the present disclosure may be formulated by the addition of one or more additives, as described in detail below, to an appropriate base oil formulation. The additives may be combined with a base oil in the form of an additive package (or concentrate) or, alternatively, may be combined individually with a base oil (or a mixture of both). The fully formulated engine oil may exhibit improved performance properties, based on the additives added and their respective proportions.

Additional details and advantages of the disclosure will be set forth in part in the description which follows, and/or may be learned by practice of the disclosure. The details and advantages of the disclosure may be realized and attained by means of the elements and combinations particularly pointed out in the appended claims. It is to be understood that both the foregoing general description and the following detailed description are exemplary and explanatory only and are not restrictive of the disclosure, as claimed.

BRIEF DESCRIPTION OF THE DRAWINGS

FIG. 1 is a graph showing the viscosity versus shear rate for a sooted oil without dispersant.

DETAILED DESCRIPTION

Providing acceptable soot and sludge handling properties to an engine lubricant composition is desirable. The introduction of dispersants into the lubricant compositions has been successful to provide the desired soot and sludge handling properties for lubricant compositions used in certain types of engines. However, heavy duty diesel (HDD) and direct gasoline injection engines (GDi engines) produce a larger amount of soot and sludge as compared to many other types of internal combustion engines. To address this problem, one option is to increase the treat rate of the dispersant that is used in lubricant compositions for HDD and GDi engines.

Typically, increasing the treat rate of a dispersant within a lubricant composition improves the soot and sludge handling properties of the lubricant composition. Due to the relatively larger amount of soot and sludge produced by HDD and GDi engines, high treat rates of dispersants are needed in the lubricant compositions to provide sufficient soot and sludge handling properties. However, increasing the dispersant treat rate in the lubricating composition beyond a certain level may be undesirable since deleterious effects on engine components, or performance may result. Specifically, high treat rates of dispersants are known to damage engine seals and enhance corrosion.

The addition of one or more dispersant(s) to a lubricant composition for use in engines, including HDD engines, is well known in the art, for example, Japanese Unexamined Patent Application Publication Number 2008-127435 discloses a lubricating oil additive that is a reaction product of a succinic acid imide and a dicarboxylic acid or anhydride thereof. This reference teaches that the use of this additive blended with a base oil provides a high coefficient of static friction. Additionally, U.S. Pat. No. 8,927,469 discloses a lubricating composition comprising a base oil and a dispersant that is a reaction product of A) a hydrocarbyl-dicarboxylic acid or anhydride, B) a polyamine, C) a dicarboxyl-containing fused aromatic compound, and D) a non-aromatic dicarboxylic acid or anhydride.

Although the use of dispersants in a lubricant composition to provide soot and sludge handling properties is known, reducing the treat rates of such dispersants, especially in lubricant compositions destined for use in HDD and GDi engines, is necessary to improve the treat-rate of the additive package and the performance of such lubricant compositions in important bench tests such as a high temperature corrosion bench test (HTCBT) such as ASTM D-6594) and a seal compatibility test such as ASTM D-7216, as well as original equipment manufacturers (OEM) seal tests from, for example, Mercedes Benz, MTU, and MAN Truck & Bus Company.

The present invention provides methods and compositions that can reduce the concentration of dispersants required for providing satisfactory soot and sludge handling properties, relative to the expected effective concentration. Applicants have determined that certain combinations of dispersants provide soot and sludge handling properties suitable for meeting or exceeding currently proposed and future lubricant performance standards at lower than expected effective concentrations.

More specifically, in some embodiments combinations of two or more dispersants having certain characteristics may result in an unexpected decrease in the total amount of dispersant necessary to provide beneficial soot and sludge handling properties to an engine lubricant composition by providing a synergistic dispersant effect. A synergistic dispersant effect is an effect which exceeds the effect that would be expected by summing of the measured effects of the proportions of each of the dispersants using in a combination of dispersants.

Various combinations of dispersants have been found to have a synergistic effect when added in combination to a lubricant composition. The synergistic effect between two or more dispersants allows for use of a lower effective concentration of the dispersant combination in the lubricant composition than would be expected from the calculated effective concentration based on measured effects for each of the two or more dispersants when used alone. The effect of a particular dispersant combination would be expected to be the sum of the expected effects of the individual components forming the dispersant combination. The present inventors have found that for some dispersant combinations, an unexpected synergistic effect is obtained.

In an aspect of the disclosure, the lubricating oil composition may comprise an additive composition containing a synergistic combination of two or more dispersants. A synergistic combination is a combination of dispersants having a lower measured effective concentration than the effective concentration calculated as the sum of the proportion of the measured effective concentration of each of the dispersants in the additive composition. Thus, the synergistic combination of dispersants provides an overall lower effective concentration for the dispersants in the lubricant composition than would be expected from the effective concentrations of the individual dispersant components employed in the combination.

The effective concentration is determined to be the concentration of the dispersant in the lubricating oil that is sufficient to obtain Newtonian fluid behavior for the lubricant composition. The Newtonian fluid behavior is measured using a rheometer. Oil containing soot is treated with one or more dispersants and the rheometer is used to determine when a Newtonian fluid is obtained. A Newtonian fluid is obtained when the slope of the curve of the viscosity versus shear rate is equal to zero. The concentration of the dispersant at which the slope is zero is the effective concentration for that dispersant. The method for determining the effective concentration is discussed in further detail in the Examples below.

Numerous different dispersant combinations may have a synergistic effect. Without being bound by theory, in one aspect the polarity created by the nitrogen within the combination of synergistic dispersants interacts with the soot contained in the lubricant composition. Additionally, the olefin copolymer tails, for example, polyisobutylene (PIB) tails and aromaticity of, for example, naphthalic anhydride, are believed to help prevent soot from agglomerating into larger soot particles in the lubricant composition. The combination of these aspects is believed to provide improved handling of soot and sludge in a lubricant composition at lower effective concentrations of the dispersant combination.

In a first embodiment, the additive composition includes a synergistic combination of a first dispersant and a second dispersant. The first dispersant is a reaction product of the following components: A) a hydrocarbyl-dicarboxylic acid or anhydride having a number average molecular weight of from 500 to 5000; B) a polyamine; C) a dicarboxyl-containing fused aromatic compound; and/or D) a non-aromatic dicarboxylic acid or anhydride having a number average molecular weight of less than 500. Components A-D used to make this dispersant are described in greater detail below. One such dispersant is described, for example, in JP2008-127435. A dispersant including a reaction product of components A-D is described in U.S. Pat. No. 8,927,469.

The second dispersant has a synergistic relationship with the first dispersant and may be a reaction product of at least: A') a hydrocarbyl-dicarboxylic acid or anhydride having a number average molecular weight of from 500 to 5000, and B') a polyamine.

Components A and A'

The hydrocarbyl moiety of the hydrocarbyl-dicarboxylic acid or anhydride of Components A and A' may be derived from butene polymers, for example polymers of isobutylene. Suitable polyisobutenes for use herein include those formed from polyisobutylene or highly reactive polyisobutylene having at least about 60%, such as about 70% to about 90% and above, terminal vinylidene content. Suitable polyisobutenes may include those prepared using $BF_3$ catalysts. The average number molecular weight of the polyalkenyl substituent may vary over a wide range, for example from about 100 to about 5000, such as from about 500 to about 5000, as determined by GPC using polystyrene as a calibration reference as described above.

The dicarboxylic acid or anhydride of Components A and A' may be selected from maleic anhydride or from carboxylic reactants other than maleic anhydride, such as maleic acid, fumaric acid, malic acid, tartaric acid, itaconic acid, itaconic anhydride, citraconic acid, citraconic anhydride, mesaconic acid, ethylmaleic anhydride, dimethylmaleic anhydride, ethylmaleic acid, dimethylmaleic acid, hexylmaleic acid, and the like, including the corresponding acid halides and lower aliphatic esters. A suitable dicarboxylic anhydride is maleic anhydride. A mole ratio of maleic anhydride to hydrocarbyl moiety in a reaction mixture used to make Component A may vary widely. Accordingly, the mole ratio may vary from about 5:1 to about 1:5, for example from about 3:1 to about 1:3, and as a further example, the maleic anhydride may be used in stoichiometric excess to force the reaction to completion. The unreacted maleic anhydride may be removed by vacuum distillation.

Component B and B'

Any of numerous polyamines can be used as Component B or B' in preparing the functionalized dispersant. The polyamine Component B or B' may be a polyalkylene polyamine Non-limiting exemplary polyamines may include ethylene diamine, propane diamine, butane diamine, diethylene triamine (DETA), triethylene tetramine (TETA), pentaethylene hexamine (PEHA), aminoethyl piperazine, tetraethylene pentamine (TEPA), N-methyl-1,3-propane diamine, N,N'-dimethyl-1,3-propane diamine, aminoguanidine bicarbonate (AGBC), and heavy polyamines such as E100 heavy amine bottoms. A heavy polyamine may comprise a mixture of polyalkylenepolyamines having small amounts of lower polyamine oligomers such as TEPA and PEHA, but primarily oligomers having seven or more nitrogen atoms, two or more primary amines per molecule, and more extensive branching than conventional polyamine mixtures. Additional non-limiting polyamines which may be used to prepare the hydrocarbyl-substituted succinimide dispersant are disclosed in U.S. Pat. No. 6,548,458, the disclosure of which is incorporated herein by reference in its entirety. Preferably, the polyamines used as Component B or B' in the reactions to form the first and second dispersants are selected from the group of triethylene tetraamine, tetraethylene pentamine, E100 heavy amine bottoms, and combinations thereof. In one preferred embodiment, the polyamine may be tetraethylene pentamine (TEPA).

In an embodiment, the functionalized first dispersant may be derived from compounds of formula (I):

(I)

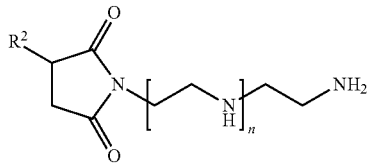

wherein n represents 0 or an integer of from 1 to 5, and $R^2$ is a hydrocarbyl substituent as defined above. In an embodiment, n is 3 and $R^2$ is a polyisobutenyl substituent, such as that derived from polyisobutylenes having at least about 60%, such as about 70% to about 90% and above, terminal vinylidene content. The second dispersant may be a compound of the Formula (I). Compounds of formula (I) may be the reaction product of a hydrocarbyl-substituted succinic anhydride, such as a polyisobutenyl succinic anhydride (PIBSA), and a polyamine, for example tetraethylene pentamine (TEPA).

The foregoing compound of formula (I) may have a molar ratio of (A) polyisobutenyl-substituted succinic anhydride to (B) polyamine in the range of from 1:1 to 10:1, preferably, 1:1 to 5:1, or 4:3 to 3:1 or 4:3 to 2:1. A particularly useful dispersant contains polyisobutenyl group of the polyisobutenyl-substituted succinic anhydride having a number average molecular weight (Mn) in the range of from about 500 to 5000 as determined by GPC using polystyrene as a calibration reference and a (B) polyamine having a general formula $H_2N(CH_2)m\text{-}[NH(CH_2)_m]_n—NH_2$, wherein m is in the range from 2 to 4 and n is in the range of from 1 to 2. Preferably, A or A' is polyisobutylene succinic anhydride (PIBSA). The PIBSA or A and A' may have an average of between about 1.0 and about 2.0 succinic acid moieties per polymer molecule.

Examples of N-substituted long chain alkenyl succinimides of the Formula (1) include polyisobutylene succinimide with number average molecular weight of the polyisobutylene substituent in the range about 350 to about 50,000, or to about 5,000, or to about 3,000. Succinimide dispersants and their preparation are disclosed, for instance in U.S. Pat. No. 7,897,696 or U.S. Pat. No. 4,234,435. The polyolefin may be prepared from polymerizable monomers containing about 2 to about 16, or about 2 to about 8, or about 2 to about 6 carbon atoms.

In an embodiment the first and/or second dispersant(s) are derived from polyisobutylene with number average molecular weight in the range about 350 to about 50,000, or to about 5000, or to about 3000. In some embodiments, polyisobutylene, when included, may have greater than 50 mol %, greater than 60 mol %, greater than 70 mol %, greater than 80 mol %, or greater than 90 mol % content of terminal double bonds. Such PIB is also referred to as highly reactive PIB ("HR-PIB"). HR-PIB having a number average molecular weight ranging from about 800 to about 5000 is suitable for use in embodiments of the present disclosure. Conventional PIB typically has less than 50 mol %, less than 40 mol %, less than 30 mol %, less than 20 mol %, or less than 10 mol % content of terminal double bonds. The % actives of the alkenyl or alkyl succinic anhydride can be determined using a chromatographic technique. This method is described in column 5 and 6 in U.S. Pat. No. 5,334,321.

An HR-PIB having a number average molecular weight ranging from about 900 to about 3000 may be suitable. Such an HR-PIB is commercially available, or can be synthesized by the polymerization of isobutene in the presence of a non-chlorinated catalyst such as boron trifluoride, as described in U.S. Pat. No. 4,152,499 to Boerzel, et al. and U.S. Pat. No. 5,739,355 to Gateau, et al. When used in the aforementioned thermal ene reaction, HR-PIB may lead to higher conversion rates in the reaction, as well as lower amounts of sediment formation, due to increased reactivity. A suitable method is described in U.S. Pat. No. 7,897,696.

Component C

Component C is an aromatic carboxylic acid, an aromatic polycarboxylic acid, or an aromatic anhydride wherein all carboxylic acid or anhydride group(s) are attached directly to an aromatic ring. Such carboxyl-containing aromatic compounds may be selected from 1,8-naphthalic acid or anhydride and 1,2-naphthalenedicarboxylic acid or anhydride, 2,3-naphthalenedicarboxylic acid or anhydride, naphthalene-1,4-dicarboxylic acid, naphthalene-2,6-dicarboxylic acid, phthalic anhydride, pyromellitic anhydride, 1,2,4-benzene tricarboxylic acid anhydride, diphenic acid or anhydride, 2,3-pyridine dicarboxylic acid or anhydride, 3,4-pyridine dicarboxylic acid or anhydride, 1,4,5,8-naphthalenetetracarboxylic acid or anhydride, perylene-3,4,9,10-tetracarboxylic anhydride, pyrene dicarboxylic acid or anhydride, and the like. The moles of this post-treatment component reacted per mole of the polyamine may range from about 0.1:1 to about 2:1. A typical molar ratio of this post-treatment component to polyamine in the reaction mixture may range from about 0.2:1 to about 2.0:1. Another molar ratio of this post-treatment component to the polyamine that may be used may range from 0.25:1 to about 1.5:1. This post-treatment component may be reacted with the other components at a temperature ranging from about 140° to about 180° C.

Component D

Component D is a non-aromatic dicarboxylic acid or anhydride. The non-aromatic dicarboxylic acid or anhydride of may have a number average molecular weight of less than 500. Suitable carboxylic acids or anhydrides thereof may include, but are not limited to acetic acid or anhydride, oxalic acid and anhydride, malonic acid and anhydride, succinic acid and anhydride, alkenyl succinic acid and anhydride, glutaric acid and anhydride, adipic acid and anhydride, pimelic acid and anhydride, suberic acid and anhydride, azelaic acid and anhydride, sebacic acid and anhydride, maleic acid and anhydride, fumaric acid and anhydride, tartaric acid and anhydride, glycolic acid and anhydride, 1,2,3,6-tetrahydronaphthalic acid and anhydride, and the like.

Component D is reacted on a molar ratio with Component B ranging from about 0.1 to about 2.5 moles of Component D per mole of Component B reacted. Typically, the amount of Component D used will be relative to the number of secondary amino groups in Component B. Accordingly, from about 0.2 to about 2.0 moles of Component D per secondary amino group in Component B may be reacted with the other components to provide the dispersant according to embodiments of the disclosure. Another molar ratio of Component D to component B that may be used may range from 0.25:1 to about 1.5:1 moles of Component D per mole of Component B. Component D may be reacted with the other components at a temperature ranging from about 140° to about 180° C.

The post-treatment step may be carried out upon completion of the reaction of the olefin copolymer with succinic anhydride, and at least one polyamine.

In an additional preferred embodiment, a combination of three or more dispersant additives may be used in the additive composition to create the synergistic effect. In a preferred combination of three dispersant additives, two or more of the dispersants comprise a reaction product of components A-D, listed and discussed in detail above.

A suitable dispersant may also be post-treated by conventional methods by a reaction with any of a variety of agents. Among these are boron, urea, thiourea, dimercaptothiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compounds. U.S. Pat. No. 7,645,726; U.S. Pat. No. 7,214,649; and U.S. Pat. No. 8,048,831 are incorporated herein by reference in their entireties.

In addition to the carbonate and boric acids post-treatments the dispersants may be post-treated, or further post-treated, with a variety of post-treatments designed to improve or impart different properties. Such post-treatments include those summarized in columns 27-29 of U.S. Pat. No. 5,241,003, hereby incorporated by reference.

The TBN of a suitable dispersant may be from about 10 to about 65 on an oil-free basis, which is comparable to about 5 to about 30 TBN if measured on a dispersant sample containing about 50% diluent oil.

The lubricant composition described herein may contain about 0.1 weight percent to about 5 weight percent of the synergistic dispersant combination described above based on a total weight of the lubricant composition. A preferred range of the amount of the synergistic dispersant combination may be from about 0.25 weight percent to about 3 weight percent based on a total weight percent of the lubricant composition. In addition to the foregoing synergistic dispersant combination, the lubricant composition contains a base oil, and may include other conventional ingredients, including but not limited to, friction modifiers, additional dispersants, metal detergents, antiwear agents, antifoam agents, antioxidants, viscosity modifiers, pour point depressants, corrosion inhibitors and the like.

Base Oil

The base oil used in the lubricating oil compositions herein may be selected from any of the base oils in Groups I-V as specified in the American Petroleum Institute (API) Base Oil Interchangeability Guidelines. The five base oil groups are as follows:

| Base oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III, or IV | | | |

Groups I, II, and III are mineral oil process stocks. Group IV base oils contain true synthetic molecular species, which are produced by polymerization of olefinically unsaturated hydrocarbons. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. It should be noted that although Group III base oils are derived from mineral oil, the rigorous processing that these fluids undergo causes their physical properties to be very similar to some true synthetics, such as PAOs. Therefore, oils derived from Group III base oils may be referred to as synthetic fluids in the industry.

The base oil used in the disclosed lubricating oil composition may be a mineral oil, animal oil, vegetable oil, synthetic oil, or mixtures thereof. Suitable oils may be derived from hydrocracking, hydrogenation, hydrofinishing, unrefined, refined, and re-refined oils, and mixtures thereof.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful. Edible oils may also be called white oils. In some embodiments, lubricating oil compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

Mineral oils may include oils obtained by drilling or from plants and animals or any mixtures thereof. For example such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be useful.

Useful synthetic lubricating oils may include hydrocarbon oils such as polymerized, oligomerized, or interpolymerized olefins (e.g., polybutylenes, polypropylenes, propyleneisobutylene copolymers); poly(1-hexenes), poly(1-octenes), trimers or oligomers of 1-decene, e.g., poly(1-decenes), such materials being often referred to as α-olefins, and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

The major amount of base oil included in a lubricating composition may be selected from the group consisting of Group I, Group II, a Group III, a Group IV, a Group V, and a combination of two or more of the foregoing, and wherein the major amount of base oil is other than base oils that arise from provision of additive components or viscosity index improvers in the composition. In another embodiment, the major amount of base oil included in a lubricating composition may be selected from the group consisting of Group II, a Group III, a Group IV, a Group V, and a combination of two or more of the foregoing, and wherein the major amount of base oil is other than base oils that arise from provision of additive components or viscosity index improvers in the composition.

The amount of the oil of lubricating viscosity present may be the balance remaining after subtracting from 100 wt % the sum of the amount of the performance additives inclusive of viscosity index improver(s) and/or pour point depressant(s) and/or other top treat additives. For example, the oil of lubricating viscosity that may be present in a finished fluid may be a major amount, such as greater than about 50 wt %, greater than about 60 wt %, greater than about 70 wt %, greater than about 80 wt %, greater than about 85 wt %, or greater than about 90 wt %.

Antioxidants

The lubricating oil compositions herein also may optionally contain one or more antioxidants. Antioxidant compounds are known and include for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Antioxidant compounds may be used alone or in combination.

The hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 available from BASF or an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms. Another commercially available hindered phenol antioxidant may be an ester and may include Ethanox™ 4716 available from Albemarle Corporation.

Useful antioxidants may include diarylamines and high molecular weight phenols. In an embodiment, the lubricating oil composition may contain a mixture of a diarylamine and a high molecular weight phenol, such that each antioxidant may be present in an amount sufficient to provide up to about 5%, by weight, based upon the final weight of the lubricating oil composition. In an embodiment, the antioxidant may be a mixture of about 0.3 to about 1.5% diarylamine and about 0.4 to about 2.5% high molecular weight phenol, by weight, based upon the final weight of the lubricating oil composition.

Examples of suitable olefins that may be sulfurized to form a sulfurized olefin include propylene, butylene, isobutylene, polyisobutylene, pentene, hexene, heptene, octene, nonene, decene, undecene, dodecene, tridecene, tetradecene, pentadecene, hexadecene, heptadecene, octadecene, nonadecene, eicosene or mixtures thereof. In one embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulfurized olefin includes sulfurized fatty acids and their esters. The fatty acids are often obtained from vegetable oil or animal oil and typically contain about 4 to about 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. Fatty acids and/or ester may be mixed with olefins, such as $\alpha$-olefins.

The one or more antioxidant(s) may be present in ranges about 0 wt % to about 20 wt %, or about 0.1 wt % to about 10 wt %, or about 1 wt % to about 5 wt %, of the lubricating oil composition.

Antiwear Agents

The lubricating oil compositions herein also may optionally contain one or more antiwear agents. Examples of suitable antiwear agents include, but are not limited to, a metal thiophosphate; a metal dialkyldithiophosphate; a phosphoric acid ester or salt thereof; a phosphate ester(s); a phosphite; a phosphorus-containing carboxylic ester, ether, or amide; a sulfurized olefin; thiocarbamate-containing compounds including, thiocarbamate esters, alkylene-coupled thiocarbamates, and bis(S-alkyldithiocarbamyl)disulfides; and mixtures thereof. A suitable antiwear agent may be a molybdenum dithiocarbamate. The phosphorus containing antiwear agents are more fully described in European Patent 612 839. The metal in the dialkyl dithio phosphate salts may be an alkali metal, alkaline earth metal, aluminum, lead, tin, molybdenum, manganese, nickel, copper, titanium, or zinc. A useful antiwear agent may be zinc dialkylthiophosphate.

Further examples of suitable antiwear agents include titanium compounds, tartrates, tartrimides, oil soluble amine salts of phosphorus compounds, sulfurized olefins, phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulfides. The tartrate or tartrimide may contain alkyl-ester groups, where the sum of carbon atoms on the alkyl groups may be at least 8. The antiwear agent may in one embodiment include a citrate.

The antiwear agent may be present in ranges including about 0 wt % to about 15 wt %, or about 0.01 wt % to about 10 wt %, or about 0.05 wt % to about 5 wt %, or about 0.1 wt % to about 3 wt % of the lubricating oil composition.

Boron-Containing Compounds

The lubricating oil compositions herein may optionally contain one or more boron-containing compounds.

Examples of boron-containing compounds include borate esters, borated fatty amines, borated epoxides, borated detergents, and borated dispersants, such as borated succinimide dispersants, as disclosed in U.S. Pat. No. 5,883,057.

The boron-containing compound, if present, can be used in an amount sufficient to provide up to about 8 wt %, about 0.01 wt % to about 7 wt %, about 0.05 wt % to about 5 wt %, or about 0.1 wt % to about 3 wt % of the lubricating oil composition.

Detergents

The lubricating oil composition may optionally further comprise one or more neutral, low based, or overbased detergents, and mixtures thereof. Suitable detergent substrates include phenates, sulfur containing phenates, sulfonates, calixarates, salixarates, salicylates, carboxylic acids, phosphorus acids, mono- and/or di-thiophosphoric acids, alkyl phenols, sulfur coupled alkyl phenol compounds, or methylene bridged phenols. Suitable detergents and their methods of preparation are described in greater detail in numerous patent publications, including U.S. Pat. No. 7,732,390 and references cited therein. The detergent substrate may be salted with an alkali or alkaline earth metal such as, but not limited to, calcium, magnesium, potassium, sodium, lithium, barium, or mixtures thereof. In some embodiments, the detergent is free of barium. A suitable detergent may include alkali or alkaline earth metal salts of petroleum sulfonic acids and long chain mono- or di-alkylarylsulfonic acids with the aryl group being benzyl, tolyl, and xylyl. Examples of suitable detergents include, but are not limited to, calcium phenates, calcium sulfur containing phenates, calcium sulfonates, calcium calixarates, calcium salixarates, calcium salicylates, calcium carboxylic acids, calcium phosphorus acids, calcium mono- and/or di-thiophosphoric acids, calcium alkyl phenols, calcium sulfur coupled alkyl phenol compounds, calcium methylene bridged phenols, magnesium phenates, magnesium sulfur containing phenates, magnesium sulfonates, magnesium calixarates, magnesium salixarates, magnesium salicylates, magnesium carboxylic acids, magnesium phosphorus acids, magnesium mono- and/or di-thiophosphoric acids, magnesium alkyl phenols, magnesium sulfur coupled alkyl phenol compounds, magnesium methylene bridged phenols, sodium phenates, sodium sulfur containing phenates, sodium sulfonates, sodium calixarates, sodium salixarates, sodium salicylates, sodium carboxylic acids, sodium phosphorus acids, sodium mono- and/or di-thiophosphoric acids, sodium alkyl phenols, sodium sulfur coupled alkyl phenol compounds, or sodium methylene bridged phenols.

Overbased detergent additives are well known in the art and may be alkali or alkaline earth metal overbased detergent additives. Such detergent additives may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

The terminology "overbased" relates to metal salts, such as metal salts of sulfonates, carboxylates, and phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, or phenols.

An overbased detergent of the lubricating oil composition may have a total base number (TBN) of about 200 mg KOH/gram or greater, or as further examples, about 250 mg KOH/gram or greater, or about 350 mg KOH/gram or greater, or about 375 mg KOH/gram or greater, or about 400 mg KOH/gram or greater.

Examples of suitable overbased detergents include, but are not limited to, overbased calcium phenates, overbased calcium sulfur containing phenates, overbased calcium sulfonates, overbased calcium calixarates, overbased calcium salixarates, overbased calcium salicylates, overbased calcium carboxylic acids, overbased calcium phosphorus acids, overbased calcium mono- and/or di-thiophosphoric acids, overbased calcium alkyl phenols, overbased calcium sulfur coupled alkyl phenol compounds, overbased calcium methylene bridged phenols, overbased magnesium phenates, overbased magnesium sulfur containing phenates, overbased magnesium sulfonates, overbased magnesium calixarates, overbased magnesium salixarates, overbased magnesium salicylates, overbased magnesium carboxylic acids, overbased magnesium phosphorus acids, overbased magnesium mono- and/or di-thiophosphoric acids, overbased magnesium alkyl phenols, overbased magnesium sulfur coupled alkyl phenol compounds, or overbased magnesium methylene bridged phenols.

The overbased detergent may have a metal to substrate ratio of from 1.1:1, or from 2:1, or from 4:1, or from 5:1, or from 7:1, or from 10:1.

In some embodiments, a detergent is effective at reducing or preventing rust in an engine.

The detergent may be present at about 0 wt % to about 10 wt %, or about 0.1 wt % to about 8 wt %, or about 1 wt % to about 4 wt %, or greater than about 4 wt % to about 8 wt %.

Additional Dispersant(s)

The lubricating oil composition may optionally further comprise one or more additional dispersants or mixtures thereof.

Additional dispersants contained in the lubricant composition may include, but are not limited to, an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. Dispersants may be selected from Mannich dispersants as described in U.S. Pat. Nos. 3,697,574 and 3,736,357; ashless succinimide dispersants as described in U.S. Pat. Nos. 4,234,435 and 4,636,322; amine dispersants as described in U.S. Pat. Nos. 3,219,666, 3,565,804, and 5,633,326; Koch dispersants as described in U.S. Pat. Nos. 5,936,041, 5,643,859, and 5,627,259, and polyalkylene succinimide dispersants as described in U.S. Pat. Nos. 5,851,965; 5,853,434; and 5,792,729.

In various embodiments, the additional dispersant may be derived from a polyalphaolefin (PAO) succinic anhydride, an olefin maleic anhydride copolymer. As an example, the additional dispersant may be described as a poly-PIBSA. In another embodiment, the additional dispersant may be derived from an anhydride which is grafted to an ethylene-propylene copolymer. Another additional dispersant may be a high molecular weight ester or half ester amide.

Another class of additional dispersants may be Mannich bases. Mannich bases are materials that are formed by the condensation of a higher molecular weight, alkyl substituted phenol, a polyalkylene polyamine, and an aldehyde such as formaldehyde. Mannich bases are described in more detail in U.S. Pat. No. 3,634,515.

The additional dispersant, if present, can be used in an amount sufficient to provide up to about 10 wt %, based upon the final weight of the lubricating oil composition. Another amount of the dispersant that can be used may be about 0.1 wt % to about 10 wt %, or about 0.1 wt % to about 10 wt %, or about 3 wt % to about 8 wt %, or about 1 wt % to about 6 wt %, based upon the final weight of the lubricating oil composition.

Friction Modifiers

The lubricating oil compositions herein also may optionally contain one or more friction modifiers. Suitable friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanadine, alkanolamides, phosphonates, metal-containing compounds, glycerol esters, sulfurized fatty compounds and olefins, sunflower oil other naturally occurring plant or animal oils, dicarboxylic acid esters, esters or partial esters of a polyol and one or more aliphatic or aromatic carboxylic acids, and the like.

Suitable friction modifiers may contain hydrocarbyl groups that are selected from straight chain, branched chain, or aromatic hydrocarbyl groups or mixtures thereof, and may be saturated or unsaturated. The hydrocarbyl groups may be composed of carbon and hydrogen or hetero atoms such as sulfur or oxygen. The hydrocarbyl groups may range from about 12 to about 25 carbon atoms. In some embodiments the friction modifier may be a long chain fatty acid ester. In another embodiment the long chain fatty acid ester may be a mono-ester, or a di-ester, or a (tri)glyceride. The friction modifier may be a long chain fatty amide, a long chain fatty ester, a long chain fatty epoxide derivative, or a long chain imidazoline.

Other suitable friction modifiers may include organic, ashless (metal-free), nitrogen-free organic friction modifiers. Such friction modifiers may include esters formed by reacting carboxylic acids and anhydrides with alkanols and generally include a polar terminal group (e.g. carboxyl or hydroxyl) covalently bonded to an oleophilic hydrocarbon chain. An example of an organic ashless nitrogen-free friction modifier is known generally as glycerol monooleate (GMO) which may contain mono-, di-, and tri-esters of oleic acid. Other suitable friction modifiers are described in U.S. Pat. No. 6,723,685, herein incorporated by reference in its entirety.

Aminic friction modifiers may include amines or polyamines. Such compounds can have hydrocarbyl groups that are linear, either saturated or unsaturated, or a mixture thereof and may contain from about 12 to about 25 carbon atoms. Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291, herein incorporated by reference in its entirety.

A friction modifier may optionally be present in ranges such as about 0 wt % to about 10 wt %, or about 0.01 wt % to about 8 wt %, or about 0.1 wt % to about 4 wt %.

Molybdenum-Containing Component

The lubricating oil compositions herein also may optionally contain one or more molybdenum-containing compounds. An oil-soluble molybdenum compound may have the functional performance of an antiwear agent, an antioxidant, a friction modifier, or mixtures thereof. An oil-soluble molybdenum compound may include molybdenum dithiocarbamates, molybdenum dialkyldithiophosphates, molybdenum dithiophosphinates, amine salts of molybdenum compounds, molybdenum xanthates, molybdenum thioxanthates, molybdenum sulfides, molybdenum carboxylates, molybdenum alkoxides, a trinuclear organo-molybdenum compound, and/or mixtures thereof. The molybdenum sulfides include molybdenum disulfide. The molybdenum disulfide may be in the form of a stable dispersion. In one embodiment the oil-soluble molybdenum compound may be selected from the group consisting of molybdenum dithiocarbamates, molybdenum dialkyldithiophosphates, amine salts of molybdenum compounds, and mixtures thereof. In one embodiment the oil-soluble molybdenum compound may be a molybdenum dithiocarbamate.

Suitable examples of molybdenum compounds which may be used include commercial materials sold under the trade names such as Molyvan 822™, Molyvan™ A, Molyvan 2000™ and Molyvan 855™ from R. T. Vanderbilt Co., Ltd., and Sakura-Lube™ S-165, S-200, S-300, 5-310G, S-525, S-600, S-700, and S-710 available from Adeka Corporation, and mixtures thereof. Suitable molybdenum components are described in U.S. Pat. No. 5,650,381; U.S. Pat. No. RE 37,363 E1; U.S. RE 38,929 E1; and U.S. RE 40,595 E1, incorporated herein by reference in their entireties.

Additionally, the molybdenum compound may be an acidic molybdenum compound. Included are molybdic acid, ammonium molybdate, sodium molybdate, potassium molybdate, and other alkaline metal molybdates and other molybdenum salts, e.g., hydrogen sodium molybdate, MoOCl4, MoO2Br2, Mo2O3Cl6, molybdenum trioxide or similar acidic molybdenum compounds. Alternatively, the compositions can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897, incorporated herein by reference in their entireties.

Another class of suitable organo-molybdenum compounds are trinuclear molybdenum compounds, such as those of the formula Mo3SkLnQz and mixtures thereof, wherein S represents sulfur, L represents independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms may be present among all the ligands' organo groups, such as at least 25, at least 30, or at least 35 carbon atoms. Additional suitable molybdenum compounds are described in U.S. Pat. No. 6,723,685, herein incorporated by reference in its entirety.

The oil-soluble molybdenum compound may be present in an amount sufficient to provide about 0.5 ppm to about 2000 ppm, about 1 ppm to about 700 ppm, about 1 ppm to about 550 ppm, about 5 ppm to about 300 ppm, or about 20 ppm to about 250 ppm of molybdenum.

Transition Metal-Containing Compounds

In another embodiment, the oil-soluble compound may be a transition metal containing compound or a metalloid. The transition metals may include, but are not limited to, titanium, vanadium, copper, zinc, zirconium, molybdenum, tantalum, tungsten, and the like. Suitable metalloids include, but are not limited to, boron, silicon, antimony, tellurium, and the like.

In an embodiment, an oil-soluble transition metal-containing compound may function as antiwear agents, friction modifiers, antioxidants, deposit control additives, or more than one of these functions. In an embodiment the oil-soluble transition metal-containing compound may be an oil-soluble titanium compound, such as a titanium (IV) alkoxide. Among the titanium containing compounds that may be used in, or which may be used for preparation of the oils-soluble materials of, the disclosed technology are various Ti (IV) compounds such as titanium (IV) oxide; titanium (IV) sulfide; titanium (IV) nitrate; titanium (IV) alkoxides such as titanium methoxide, titanium ethoxide, titanium propoxide, titanium isopropoxide, titanium butoxide, titanium 2-ethylhexoxide; and other titanium compounds or complexes including but not limited to titanium phenates; titanium carboxylates such as titanium (IV) 2-ethyl-1-3-hexanedioate or titanium citrate or titanium oleate; and titanium (IV) (triethanolaminato)isopropoxide. Other forms of titanium encompassed within the disclosed technology include titanium phosphates such as titanium dithiophosphates (e.g., dialkyldithiophosphates) and titanium sulfonates (e.g., alkylbenzenesulfonates), or, generally, the reaction product of titanium compounds with various acid materials to form salts, such as oil-soluble salts. Titanium compounds can thus be derived from, among others, organic acids, alcohols, and glycols. Ti compounds may also exist in dimeric or oligomeric form, containing Ti—O—Ti structures. Such titanium materials are commercially available or can be readily prepared by appropriate synthesis techniques which will be apparent to the person skilled in the art. They may exist at room temperature as a solid or a liquid, depending on the particular compound. They may also be provided in a solution form in an appropriate inert solvent.

In one embodiment, the titanium can be supplied as a Ti-modified dispersant, such as a succinimide dispersant. Such materials may be prepared by forming a titanium mixed anhydride between a titanium alkoxide and a hydrocarbyl-substituted succinic anhydride, such as an alkenyl- (or alkyl) succinic anhydride. The resulting titanate-succinate intermediate may be used directly or it may be reacted with any of a number of materials, such as (a) a polyamine-based succinimide/amide dispersant having free, condensable —NH functionality; (b) the components of a polyamine-based succinimide/amide dispersant, i.e., an alkenyl- (or alkyl-) succinic anhydride and a polyamine, (c) a hydroxy-containing polyester dispersant prepared by the reaction of a substituted succinic anhydride with a polyol, aminoalcohol, polyamine, or mixtures thereof. Alternatively, the titanate-succinate intermediate may be reacted with other agents such as alcohols, aminoalcohols, ether alcohols, polyether alcohols or polyols, or fatty acids, and the product thereof either used directly to impart Ti to a lubricant, or else further reacted with the succinic dispersants as described above. As an example, 1 part (by mole) of tetraisopropyl titanate may be reacted with about 2 parts (by mole) of a polyisobutene-substituted succinic anhydride at 140-150° C. for 5 to 6 hours to provide a titanium modified dispersant or intermediate. The resulting material (30 g) may be further reacted with a succinimide dispersant from polyisobutene-substituted succinic anhydride and a polyethylenepolyamine mixture (127 grams+diluent oil) at 150° C. for 1.5 hours, to produce a titanium-modified succinimide dispersant.

Another titanium containing compound may be a reaction product of titanium alkoxide and $C_6$ to $C_{25}$ carboxylic acid. The reaction product may be represented by the following formula:

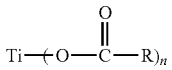

wherein n is an integer selected from 2, 3 and 4, and R is a hydrocarbyl group containing from about 5 to about 24 carbon atoms, or by the formula:

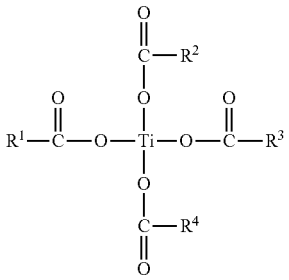

wherein each of $R^1$, $R^2$, $R^3$, and $R^4$ are the same or different and are selected from a hydrocarbyl group containing from about 5 to about 25 carbon atoms. Suitable carboxylic acids may include, but are not limited to caproic acid, caprylic acid, lauric acid, myristic acid, palmitic acid, stearic acid, arachidic acid, oleic acid, erucic acid, linoleic acid, linolenic acid, cyclohexanecarboxylic acid, phenylacetic acid, benzoic acid, neodecanoic acid, and the like.

In an embodiment the oil soluble titanium compound may be present in the lubricating oil composition in an amount to provide from 0 to 3000 ppm titanium by weight or 25 to about 1500 ppm titanium by weight or about 35 ppm to 500 ppm titanium by weight or about 50 ppm to about 300 ppm.

Viscosity Index Improvers

The lubricating oil compositions herein also may optionally contain one or more viscosity index improvers. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in US Publication No. 20120101017A1.

The lubricating oil compositions herein also may optionally contain one or more dispersant viscosity index improvers in addition to a viscosity index improver or in lieu of a viscosity index improver. Suitable viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity index improver and/or dispersant viscosity index improver may be about 0 wt % to about 20 wt %, about 0.1 wt % to about 15 wt %, about 0.1 wt % to about 12 wt %, or about 0.5 wt % to about 10 wt %, of the lubricating oil composition.

Other Optional Additives

Other additives may be selected to perform one or more functions required of a lubricating fluid. Further, one or more of the mentioned additives may be multi-functional and provide functions in addition to or other than the function prescribed herein.

A lubricating oil composition according to the present disclosure may optionally comprise other performance additives. The other performance additives may be in addition to specified additives of the present disclosure and/or may comprise one or more of metal deactivators, viscosity index improvers, detergents, ashless TBN boosters, friction modifiers, antiwear agents, corrosion inhibitors, rust inhibitors, dispersants, dispersant viscosity index improvers, extreme pressure agents, antioxidants, foam inhibitors, demulsifiers, emulsifiers, pour point depressants, seal swelling agents and mixtures thereof. Typically, fully-formulated lubricating oil will contain one or more of these performance additives.

Suitable metal deactivators may include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Suitable foam inhibitors include silicon-based compounds, such as siloxane.

Suitable pour point depressants may include a polymethylmethacrylates or mixtures thereof. Pour point depressants may be present in an amount sufficient to provide from about 0 wt % to about 1 wt %, about 0.01 wt % to about 0.5 wt %, or about 0.02 wt % to about 0.04 wt % based upon the final weight of the lubricating oil composition.

Suitable rust inhibitors may be a single compound or a mixture of compounds having the property of inhibiting corrosion of ferrous metal surfaces. Non-limiting examples of rust inhibitors useful herein include oil-soluble high molecular weight organic acids, such as 2-ethylhexanoic acid, lauric acid, myristic acid, palmitic acid, oleic acid, linoleic acid, linolenic acid, behenic acid, and cerotic acid, as well as oil-soluble polycarboxylic acids including dimer and trimer acids, such as those produced from tall oil fatty acids, oleic acid, and linoleic acid. Other suitable corrosion inhibitors include long-chain alpha, omega-dicarboxylic acids in the molecular weight range of about 600 to about 3000 and alkenylsuccinic acids in which the alkenyl group contains about 10 or more carbon atoms such as, tetrapropenylsuccinic acid, tetradecenylsuccinic acid, and hexadecenylsuccinic acid. Another useful type of acidic corrosion inhibitors are the half esters of alkenyl succinic acids having about 8 to about 24 carbon atoms in the alkenyl group with alcohols such as the polyglycols. The corresponding half amides of such alkenyl succinic acids are also useful. A useful rust inhibitor is a high molecular weight organic acid. In some embodiments, an engine oil is devoid of a rust inhibitor.

The rust inhibitor, if present, can be used in an amount sufficient to provide about 0 wt % to about 5 wt %, about 0.01 wt % to about 3 wt %, about 0.1 wt % to about 2 wt %, based upon the final weight of the lubricating oil composition.

In general terms, a suitable lubricant composition may include additive components in the ranges listed in the following Table 2.

TABLE 2

| Component | Wt. % (Suitable Embodiments) | Wt. % (Preferred Embodiments) |
|---|---|---|
| Synergistic Dispersant Combination | 0.15-5.0 | 0.25-3.0 |
| Additional Dispersant(s) | 0.1-10.0 | 1.0-8.5 |
| Antioxidant(s) | 0.1-5.0 | 0.01-3.0 |
| Detergent(s) | 0.1-15.0 | 0.2-8.0 |
| Ashless TBN booster(s) | 0.0-1.0 | 0.01-0.5 |
| Corrosion inhibitor(s) | 0.0-5.0 | 0.0-2.0 |
| Metal dihydrocarbyl dithiophosphate(s) | 0.1-6.0 | 0.1-4.0 |
| Ash-free phosphorus compound(s) | 0.0-6.0 | 0.0-4.0 |
| Antifoaming agent(s) | 0.0-5.0 | 0.001-0.15 |
| Antiwear agent(s) | 0.0-1.0 | 0.0-0.8 |
| Pour point depressant(s) | 0.0-5.0 | 0.01-1.5 |
| Viscosity index improver(s) | 0.0-20.0 | 0.25-10.0 |
| Dispersant viscosity index improver(s) | 0.0-10.0 | 0.0-5.0 |
| Friction modifier(s) | 0.01-5.0 | 0.05-2.0 |
| Base oil(s) | Balance | Balance |
| Total | 100 | 100 |

The percentages of each component above represent the weight percent of each component, based upon the weight of the final lubricating oil composition. The remainder of the lubricating oil composition consists of one or more base oils.

Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent).

EXAMPLES

The following examples are illustrative, but not limiting, of the methods and compositions of the present disclosure. Other suitable modifications and adaptations of the variety of conditions and parameters normally encountered in the field, and which are obvious to those skilled in the art, are within the spirit and scope of the disclosure. All patents and publications cited herein are fully incorporated by reference herein in their entirety.

Test to Assess Measured Effective Concentration

In order to evaluate lubricant formulations according to the disclosure, various combinations of dispersants were tested for their ability to disperse soot. A sooted oil having 4.3 wt. % soot was generated from a fired diesel engine using a fluid that contained no dispersants. The oil was then tested by a shear rate sweep in a rheometer with a cone on plate to determine Newtonian/non-Newtonian behavior.

The results for the untreated sooted oil are shown in FIG. 1.

An untreated sooted oil (Curve A containing no dispersant) provided a non-linear curve for viscosity as a function of shear rate, which indicates that it is a non-Newtonian fluid and that soot is agglomerating in the oil. The higher viscosity that was observed at lower shear indicates soot agglomeration. The slope for the untreated sooted oil was approximately 0.00038.

The lubricant compositions used in the following Examples were prepared using samples of the same sooted oil as prepared above. A single dispersant or an additive composition was added in varying concentrations to the sooted oil. Additional components present in each of the formulations included: antioxidant(s); detergent(s); ashless TBN booster(s); corrosion inhibitor(s); metal dihydrocarbyldithiophosphate(s); ash-free phosphorus compound(s); antifoaming agent(s); antiwear agent(s); pour point depressant(s); and friction modifier(s). The amount of sooted oil was varied to provide the balance of the composition to account for the variations in the amount of the dispersants, or additive compositions used in each lubricant composition. The amounts of all of the other additives in the lubricant composition were held constant.

Each lubricant composition was subjected to a shear rate sweep in a rheometer with a cone on plate to determine Newtonian/non-Newtonian behavior and, to measure the effective concentrations of the dispersants or additive compositions at which Newtonian behavior was observed. All tests were performed at the same constant temperature of 100° C. Several concentrations of dispersant were tested for each lubricant composition. The slope of each curve was calculated. The effective concentration of the dispersant was deemed to be the concentration of the dispersant in the lubricant, at which the lubricant composition exhibited Newtonian behavior. The effective concentration was thus the concentration of dispersant that provided a lubricant composition that exhibited no change in viscosity with shear rate over time. This was determined by finding the concentration of dispersant at which the slope of the curve for the viscosity versus shear rate was zero.

Tests were run on lubricant compositions containing each of the first and second dispersants alone (Comparative Examples 1 and 2), as well as on lubricant compositions with several different concentrations of various combinations of synergistic dispersants (Examples 1-5).

To provide data for calculation of the calculated effective concentrations (EC) for each of Comparative Examples 1-2 and Examples 1-5, the effective concentration for each individual dispersant used in these examples was determined and is shown in Table 3. Each of the reaction products had a molar ratio of PIBSA:amine in the range of 4:3 to 2:1 except as otherwise specified.

TABLE 3

| Dispersant | EC |
|---|---|
| Reaction Product of HR-PIBSA + TEPA | 1.51 |
| Reaction Product of HR-PIBSA + TETA (mole ratio of SA:PIB of 1.75) and E-100 Bottoms post-treated with NA/MA | 1.04 |
| Reaction Product of HR-PIBSA + TETA (mole ratio of SA:PIB of 1.75) and E-100 Bottoms post-treated with MA/BA | 7.23 |
| Succinimide dispersant based on a mixture of 1300 MW and 2300 MW HR PIB with a 3:1 PIBSA:amine ratio | 7.63 |
| Reaction Product of HR-PIBSA (mole ratio SA:PIB 1.15) + TETA and E-100 Bottoms | 3.29 |
| Reaction Product of PIBSA (mole ratio SA:PIB 1.75) + TEPA post-treated with NA | 0.99 |

Comparative Example 1

A lubricant composition was prepared using a sample of the above-described sooted oil, and an additive composition containing two dispersants along with the additional additives listed above. The first dispersant was a PIBSA containing a mixture of MW 1300 HR PIB and MW 2300 HR PIB. The second dispersant was a reaction product of highly reactive PIB and succinic anhydride ("SA") using a molar ratio of SA:PIB of 1.75:1. The resultant PIBSA was then reacted with tetraethylenepentamine ("TEPA") using a molar ratio of PIBSA:amine in the range of 4:3 to 2:1.

The percentage by weight of the first dispersant in the lubricant composition was maintained constant at 29.5 wt. % to provide 2.25 wt. % of polymer to the lubricant composition, based on the total weight of the lubricant composition. The percentage by weight of the second dispersant was varied to deliver different amounts of the polymer of the second dispersant to the lubricant composition, based on the total weight of the lubricant composition. The additive composition was added to the sooted oil to create the lubricant composition.

The measured effective concentration of the combination of dispersants in the lubricant composition was determined using the method outlined above.

The calculated effective concentration for the combination of the dispersants in the additive composition was determined by adding the calculated effective concentration for each of the individual dispersants in the composition. The calculated effective concentration for the first dispersant is determined by multiplying the percentage of the dispersant in the additive composition, in this case 29.5%, by the measured effective concentration (7.63 wt. %) for that dispersant, which was determined using the process discussed above and can be found in Table 3.

The calculated effective concentration for the second dispersant is calculated by multiplying the remaining percentage of dispersant, in this case, 70.5% by the measured effective concentration for the dispersant (1.51 wt. %). The measured effective concentration of the second dispersant was determined using the process discussed above, and is included in Table 3.

The calculated effective concentration for the individual dispersants in the additive composition was 2.25 wt. % and 1.06 wt. %, respectively. Therefore, the calculated effective concentration for the additive composition containing both dispersants was 3.31 wt. % of polymer, based on the total weight of the lubricant composition. The measured effective concentration for this additive composition was 4.26 wt. % based on the total weight of the lubricant composition. The measured effective concentration was determined by graphing the viscosity versus shear rate and finding the concentration at which the slope of the curve is zero. The measured effective concentration and the calculated effective concentration are shown in Table 4. In this case the calculated effective concentration is less than the measured effective concentration, which demonstrates that these two dispersants do not produce a synergistic effect.

Comparative Example 2

A lubricant composition was prepared using a sample of the above-described sooted oil, and an additive composition containing two dispersants along with the additional additives listed above. The first dispersant was a post-treated reaction product of a PIBSA containing a highly reactive PIB having a molar ratio of SA:PIB of 1.2:1 with triethylene tetramine and E-100 bottoms, at a molar ratio of PIBSA:amine in the range of 4:3 to 2:1. The reaction product was post treated with maleic anhydride and boric acid.

The second dispersant was a reaction product of a PIBSA containing a highly reactive PIB having a molar ratio of SA:PIB of 1.75:1 with tetraethylene pentamine, at a molar ratio of PIBSA:amine in the range of 4:3 to 2:1.

The percentage by weight of the first dispersant in the lubricant composition was maintained constant at 25 wt. % to provide 1.81 wt. % of polymer to the lubricant composition, based on the total weight of the lubricant composition. The percentage by weight of the second dispersant was varied to deliver different amounts of the polymer of the second dispersant to the lubricant composition, based on the total weight of the lubricant composition. The additive composition was added to the sooted oil to create the lubricant composition.

The measured effective concentration of the combination of dispersants in the lubricant composition was determined using the method outlined above.

The calculated effective concentration for the combination of the dispersants in the additive composition was determined by adding the calculated effective concentration for each of the individual dispersants in the composition. The calculated effective concentration for the first dispersant is determined by multiplying the percentage of the dispersant in the additive composition, in this case 25%, by the measured effective concentration (7.23 wt. %) for that dispersant, which was determined using the process discussed above and can be found in Table 3.

The calculated effective concentration for the second dispersant is calculated by multiplying the remaining percentage of dispersant, in this case, 75% by the measured effective concentration for the dispersant (1.51 wt. %). The measured effective concentration of the second dispersant was determined using the process discussed above, and is included in Table 3.

The calculated effective concentration for the individual dispersants in the additive composition was 1.81 wt. % and 1.13 wt. %, respectively. Therefore, the calculated effective concentration for the additive composition containing both dispersants was 2.94 wt. % of polymer, based on the total weight of the lubricant composition. The measured effective concentration for this additive composition was 3.36 wt. % based on the total weight of the lubricant composition. The measured effective concentration was determined by graphing the viscosity versus shear rate and finding the concentration at which the slope of the curve is zero. The measured effective concentration and the calculated effective concentration are shown in Table 4. In this case the calculated effective concentration is less than the measured effective concentration, which demonstrates that these two dispersants do not produce a synergistic effect.

Example 1

A lubricant composition was prepared using a sample of the above-described sooted oil, and an additive composition containing two dispersants along with the additional additives listed above. The first dispersant was a PIBSA containing a mixture of MW 1300 HR PIB and MW 2300 MW PIB.

The second dispersant in the combination was a post-treated reaction product of a PIBSA containing a highly reactive PIB having a molar ratio of SA:PIB of 1.75:1 with tetraetylene pentamine, at a molar ratio of PIBSA:amine in the range of 4:3 to 2:1. The reaction product was then post treated with naphthalic anhydride. The percentage by weight of the first dispersant in the lubricant composition was maintained constant at 29.5 wt. % to provide 2.25 wt. % of polymer to the lubricant composition, based on the total weight of the lubricant composition. The percentage by weight of the second dispersant was varied to deliver different amounts of the polymer of the second dispersant to the lubricant composition, based on the total weight of the lubricant composition. The additive composition was added to the sooted oil to create the lubricant composition.

The measured effective concentration for the lubricant composition was determined using the method outlined above. The calculated effective concentration for the combination of the dispersants was calculated using the method as described in Comparative Example 1. The calculated effective concentration for the first and second dispersants was calculated from the measured effective concentrations shown in Table 3 using 29.5% for the first dispersant and 70.5% for the second dispersant. The measured effective concentration for the additive composition was 2.78 wt. % and the calculated effective concentration was 2.94 wt. %. The results are shown in Table 4. The lower measured effective concentration as compared to the calculated effective concentration indicates that these two dispersant provided a synergistic effect.

Example 2

A lubricant composition was prepared using a sample of the above-described sooted oil, and an additive composition containing two dispersants along with the additional additives listed above. The first dispersant in the combination was the reaction product of highly reactive PIB and succinic anhydride SA having a molar ratio of SA:PIB of 1.15:1 and a mixture of triethylenetetramine and E-100 (bottoms), at a molar ratio of PIBSA:amine in the range of 4:3 to 2:1.

The second dispersant in the combination was the post-treated reaction product of highly reactive PIB and succinic anhydride in a molar ratio of SA:PIB of 1.75:1 with a mixture of triethylenetetramine and E-100 (bottoms), with a molar ratio of PIBSA:amine in the range of 4:3 to 2:1. The product was then post treated with a mixture of naphthalic anhydride and maleic anhydride. The percentage by weight of the first dispersant in the lubricant composition was maintained constant at 50 wt. % to provide 1.65 wt. % of polymer to the lubricant composition, based on the total weight of the lubricant composition. The percentage by weight of the second dispersant was varied to deliver different amounts of the polymer of the second dispersant to the lubricant composition, based on the total weight of the lubricant composition. The additive composition was added to the sooted oil to create the lubricant composition.

The measured effective concentration for the lubricant composition was determined using the method outlined above. The calculated effective concentration for the combination of the dispersants was calculated using the method as described in Comparative Example 1. The calculated effective concentration for the first and second dispersants was calculated from the measured effective concentrations shown in Table 3 using 50% for the first dispersant and 50% for the second dispersant. The measured effective concentration for the additive composition was 1.89 wt. % and the calculated effective concentration was 2.165 wt. %. The results are shown in Table 4. The lower measured effective concentration as compared to the calculated effective concentration indicates that these two dispersant provided a synergistic effect.

Example 3

A lubricant composition was prepared using a sample of the above-described sooted oil, and an additive composition containing three dispersants along with the additional additives listed above. The first dispersant was a PIBSA containing a mixture of MW 1300 HR PIB and MW 2300 HR PIB.

The second dispersant was the reaction product of highly reactive PIB, SA in a molar ratio of SA:PIB of 1.2:1 and a mixture of triethylene tetramine and E-100 heavy amine bottoms, with a molar ratio of PIBSA:amine in the range of 4:3 to 2:1. The product was then post-treated with a mixture of maleic anhydride and boric acid.

The third dispersant in the combination was the reaction product of highly reactive PIB, SA having a molar ratio of SA:PIB of 1.75:1 and tetraetylene pentamine at a molar ratio of PIBSA:amine in the range of 4:3 to 2:1. The reaction product was then post treated with naphthalic anhydride. The percentage by weight of the first and second dispersants in the lubricant composition were maintained constant at 25 wt. % each to provide 1.911 wt. % and 1.810 wt. % of polymer to the lubricant composition, based on the total weight of the lubricant composition, respectively. The percentage by weight of the third dispersant was varied to deliver different amounts of the polymer of the third dispersant to the lubricant composition, based on the total weight of the lubricant composition. The additive composition was added to the sooted oil to create the lubricant composition.

The measured effective concentration for the lubricant composition was determined using the method outlined above. The calculated effective concentration for the combination of the three dispersants was calculated using the method as described in Comparative Example 1, with the third dispersant also being included in the percentage calculation. The calculated effective concentration for the combination of the first, second, and third dispersants was calculated from the measured effective concentrations of each of the three individual dispersants shown in Table 3 using 25% for the first dispersant, 25% for the second dispersant, and 50% for the third dispersant. The measured effective concentration for the additive composition was 3.94 wt. % and the calculated effective concentration was 4.216 wt. %. The results are shown in Table 4. The lower measured effective concentration as compared to the calculated effective concentration indicates that this combination of three dispersants provided a synergistic effect.

TABLE 4

| Dispersant | Calculated Effective Concentration (wt. %) | Measured Effective Concentration (wt. %) |
|---|---|---|
| Combination of Comparative Ex. 1 | 3.31 | 4.26 |
| Combination of Comparative Ex. 2 | 2.94 | 3.36 |
| Combination of Example 1 | 2.94 | 2.78 |
| Combination of Example 2 | 2.165 | 1.89 |
| Combination of Example 3 | 4.216 | 3.94 |
| Combination of Example 4 | 2.55 | 2.24 |
| Combination of Example 5 | 6.325 | 2.52 |

Example 4

A lubricant composition was prepared using a sample of the above-described sooted oil, and an additive composition containing two dispersants along with the additional additives listed above. The first dispersant was a post-treated reaction product of a PIBSA containing a highly reactive PIB having a molar ratio of SA:PIB of 1.2:1 with triethylene tetramine and E-100 bottoms, at a molar ratio of PIBSA: amine in the range of 4:3 to 2:1. The reaction product was then post treated with maleic anhydride and boric acid.

The second dispersant in the combination was a post-treated reaction product of a PIBSA containing a highly reactive PIB having a molar ratio of SA:PIB of 1.75:1 with tetraetylene pentamine, at a molar ratio of PIBSA:amine in the range of 4:3 to 2:1. The reaction product was then post treated with naphthalic anhydride. The percentage by weight of the first dispersant in the lubricant composition was maintained constant at 25 wt. % to provide 1.81 wt. % of polymer to the lubricant composition, based on the total weight of the lubricant composition. The percentage by weight of the second dispersant was varied to deliver different amounts of the polymer of the second dispersant to the lubricant composition, based on the total weight of the lubricant composition. The additive composition was added to the sooted oil to create the lubricant composition.

The measured effective concentration for the lubricant composition was determined using the method outlined above. The calculated effective concentration for the combination of the dispersants was calculated using the method as described in Comparative Example 1. The calculated effective concentration for the first and second dispersants was calculated from the measured effective concentrations shown in Table 3 using 25% for the first dispersant and 75% for the second dispersant. The measured effective concentration for the additive composition was 2.24 wt. % and the calculated effective concentration was 2.55 wt. %. The results are shown in Table 4. The lower measured effective concentration as compared to the calculated effective concentration indicates that these two dispersants provided a synergistic effect.

Example 5

A lubricant composition was prepared using a sample of the above-described sooted oil, and an additive composition containing two dispersants along with the additional additives listed above. The first dispersant was a post-treated reaction product of a PIBSA containing a highly reactive PIB having a molar ratio of SA:PIB of 1.2:1 with triethylene tetramine and E-100 bottoms, at a molar ratio of PIBSA: amine in the range of 4:3 to 2:1. The reaction product was then post treated with maleic anhydride and boric acid.

The second dispersant in the combination was a post-treated reaction product of a PIBSA containing a highly reactive PIB having a molar ratio of SA:PIB of 1.75:1 with triethylene tetramine and E-100 bottoms, at a molar ratio of PIBSA:amine in the range of 4:3 to 2:1. The reaction product was then post treated with naphthalic anhydride and maleic anhydride. The percentage by weight of the first dispersant in the lubricant composition was maintained constant at 14 wt. % to provide 1.04 wt. % of polymer to the lubricant composition, based on the total weight of the lubricant composition. The percentage by weight of the second dispersant was varied to deliver different amounts of the polymer of the second dispersant to the lubricant composition, based on the total weight of the lubricant composition. The additive composition was added to the sooted oil to create the lubricant composition.

The measured effective concentration for the lubricant composition was determined using the method outlined above. The calculated effective concentration for the combination of the dispersants was calculated using the method as described in Comparative Example 1. The calculated effective concentration for the first and second dispersants was calculated from the measured effective concentrations shown in Table 3 using 14% for the first dispersant and 86% for the second dispersant. The measured effective concentration for the additive composition was 6.325 wt. % and the calculated effective concentration was 2.52 wt. %. The results are shown in Table 4. The lower measured effective concentration as compared to the calculated effective concentration indicates that these two dispersant provided a synergistic effect.

Example 6

A lubricant composition was prepared using a sample of the above-described sooted oil, and an additive composition containing two dispersants along with the additional additives listed above. The first dispersant was a PIBSA containing a mixture of MW 1300 HR PIB and MW 2300 HR PIB.

The second dispersant in the combination was a reaction product of highly reactive PIB, SA in a molar ratio of SA:PIB of 1.75:1 and tetraetylene pentamine at a ratio of PIBSA:amine in the range of 4:3 to 2:1. The reaction product was then post treated with naphthalic anhydride.

Three different percentages by weight of the first dispersant were used in the lubricant composition in three separate tests. In the first test the first dispersant weight percentage was maintained constant at 29.5 wt. % to provide 2.25 wt. % of polymer to the lubricant composition, based on the total weight of the lubricant composition. In the second test the weight percentage of the first dispersant was maintained constant at 10 wt. % to provide 0.763 wt. % polymer, and in the third test the first dispersant was held constant at 5 wt. % to provide 0.382 wt. % polymer to the lubricant composition, all based on the total weight of the lubricant composition. The percentage by weight of the second dispersant was varied in each test to deliver different amounts of the polymer of the second dispersant to the lubricant composition, based on the total weight of the lubricant composition.

The additive composition was added to the sooted oil to create the lubricant composition.

The measured effective concentration for the lubricant composition was determined using the method outlined above. The calculated effective concentration for the combination of the dispersants was calculated using the method as described in Comparative Example 1. For the first test, the calculated effective concentration for the first and second dispersants was calculated from the measured effective concentrations shown in Table 3 using 29.5% for the first dispersant and 70.5% for the second dispersant. The measured effective concentration for the additive composition was 2.78 wt. % and the calculated effective concentration was 2.94 wt. %.

For the second test, the calculated effective concentration for the first and second dispersants was calculated from the measured effective concentrations shown in Table 3 using 10% for the first dispersant and 90% for the second dispersant. The measured effective concentration for the additive composition was 1.63 wt. % and the calculated effective concentration was 1.654 wt. %.

For the third test, the calculated effective concentration for the first and second dispersants was calculated from the measured effective concentrations shown in Table 3 using 5% for the first dispersant and 95% for the second dispersant. The measured effective concentration for the additive composition was 1.41 wt. % and the calculated effective concentration was 1.322 wt. %.

The results for Example 6 are shown in Table 5. The lower measured effective concentration for the first and second tests as compared to the calculated effective concentration indicates that these two combinations of the first and second dispersants provided a synergistic effect. However, for the lowest concentration of the first dispersant, the calculated effective concentration is lower than the measured effective concentrations showing that no synergistic effect was observed at this relatively low concentration of the first dispersant.

TABLE 5

| Percentage of Dispersant 1 based on Total Dispersant | Calculated Effective Concentration (wt. %) | Measured Effective Concentration (wt. %) |
|---|---|---|
| 29.50% | 2.94 | 2.78 |
| 10% | 1.654 | 1.63 |
| 5% | 1.322 | 1.41 |

Example 7

A lubricant composition was prepared using a sample of the above-described sooted oil, and an additive composition containing two dispersants along with the additional additives listed above. The first dispersant was a post-treated reaction product of a PIBSA containing a highly reactive PIB having a molar ratio of SA:PIB of 1.2:1 with triethylene tetramine and E-100 bottoms, at a molar ratio of PIBSA:amine in the range of 4:3 to 2:1. The reaction product was post treated with maleic anhydride and boric acid.

The second dispersant in the combination was a post-treated reaction product of highly reactive PIB, SA in a molar ratio of SA:PIB of 1.75:1 and tetraetylene pentamine at a ratio of PIBSA:amine in the range of 4:3 to 2:1. The reaction product was then post treated with naphthalic anhydride.

Three different percentages by weight of the first dispersant were used in the lubricant composition in three separate tests. In the first test the first dispersant weight percentage was maintained constant at 25 wt. % to provide 1.81 wt. % of polymer to the lubricant composition, based on the total weight of the lubricant composition. In the second test the weight percentage of the first dispersant was maintained constant at 10 wt. % to provide 0.724 wt. % polymer, and in the third test the first dispersant was held constant at 5 wt. % to provide 0.362 wt. % polymer to the lubricant composition, all based on the total weight of the lubricant composition. The percentage by weight of the second dispersant was varied in each test to deliver different amounts of the polymer of the second dispersant to the lubricant composition, based on the total weight of the lubricant composition. The additive composition was added to the sooted oil to create the lubricant composition.

The measured effective concentration for the lubricant composition was determined using the method outlined above. The calculated effective concentration for the combination of the dispersants was calculated using the method as described in Comparative Example 1. For the first test, the calculated effective concentration for the first and second dispersants was calculated from the measured effective concentrations shown in Table 3 using 25% for the first dispersant and 75% for the second dispersant. The measured effective concentration for the additive composition was 2.24 wt. % and the calculated effective concentration was 2.55 wt. %.

For the second test, the calculated effective concentration for the first and second dispersants was calculated from the measured effective concentrations shown in Table 3 using 10% for the first dispersant and 90% for the second dispersant. The measured effective concentration for the additive composition was 1.398 wt. % and the calculated effective concentration was 1.615 wt. %.

For the third test, the calculated effective concentration for the first and second dispersants was calculated from the measured effective concentrations shown in Table 3 using 5% for the first dispersant and 95% for the second dispersant. The measured effective concentration for the additive composition was 1.485 wt. % and the calculated effective concentration was 1.303 wt. %.

The results for Example 7 are shown in Table 6. The lower measured effective concentration for the first and second tests as compared to the calculated effective concentration indicates that these two combinations of the first and second dispersants provided a synergistic effect. However, for the lowest concentration of the first dispersant, the calculated effective concentration is lower than the measured effective concentrations showing that no synergistic effect was observed at this relatively low concentration of the first dispersant.

TABLE 6

| Percentage of Dispersant 1 based on Total Dispersant | Calculated Effective Concentration (wt. %) | Measured Effective Concentration (wt. %) |
|---|---|---|
| 25% | 2.55 | 2.24 |
| 10% | 1.615 | 1.398 |
| 5% | 1.303 | 1.485 |

Other embodiments of the present disclosure will be apparent to those skilled in the art from consideration of the specification and practice of the embodiments disclosed herein. As used throughout the specification and claims, "a"

and/or "an" may refer to one or more than one. Unless otherwise indicated, all numbers expressing quantities of ingredients, properties such as molecular weight, percent, ratio, reaction conditions, and so forth used in the specification and claims are to be understood as being modified in all instances by the term "about," whether or not the term "about" is present. Accordingly, unless indicated to the contrary, the numerical parameters set forth in the specification and claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. It is intended that the specification and examples be considered as exemplary only, with a true scope and spirit of the disclosure being indicated by the following claims.

The foregoing embodiments are susceptible to considerable variation in practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. An engine oil composition comprising:

about 50% to about 99% by weight of a base oil, based on the total weight of the engine oil composition, and an additive composition, said additive composition comprising:

(a) at least 0.05 percent by weight, based on a total weight of the engine oil composition, of a first dispersant that is a reaction product of A) a hydrocarbyl-dicarboxylic acid or anhydride, and B) at least one polyamine; and (b) at least 0.05 percent by weight, based on a total weight of the engine oil composition, of a second dispersant that is a reaction product of A') a hydrocarbyl-dicarboxylic acid or anhydride, and B') at least one polyamine, and wherein said reaction product is post-treated with C) an aromatic carboxylic acid, an aromatic polycarboxylic acid, or an aromatic anhydride wherein all carboxylic acid or anhydride groups are attached directly to an aromatic ring, and D) a non-aromatic dicarboxylic acid or anhydride having a number average molecular weight of less than about 500, wherein reaction product of the second dispersant has a ratio of A' to B' in the range of 4:3 to 2:1.

2. The engine oil composition of claim 1, wherein the hydrocarbyl dicarboxylic acid or anhydride A' comprises a polyisobutenyl succinic acid or anhydride.

3. The engine oil composition of claim 2, wherein C comprises 1,8-naphthalic anhydride, and D comprises maleic anhydride.

4. The engine oil composition of claim 2, wherein D comprises maleic anhydride.

5. The engine oil composition of claim 1, wherein the hydrocarbyl dicarboxylic acids or anhydrides A and A' each comprise a polyisobutenyl succinic acid or anhydride.

6. The engine oil composition of claim 5, wherein the second dispersant is a reaction product of components A' and B', with C) a dicarboxyl-containing fused aromatic compound or anhydride thereof, and D) a non-aromatic dicarboxylic acid or anhydride having a number average molecular weight of less than about 500.

7. The engine oil composition of claim 1, wherein the additive composition comprises a third dispersant that is different from the first and second dispersants.

8. The engine oil composition of claim 7, wherein the third dispersant is a polyisobutenyl succinic acid or anhydride.

9. The engine oil composition of claim 7, wherein the third dispersant is a reaction product of a A') hydrocarbyl-dicarboxylic acid or anhydride, and B') at least one polyamine that is post-treated with C) an aromatic carboxylic acid, an aromatic polycarboxylic acid, or an aromatic anhydride wherein all carboxylic acid or anhydride groups are attached directly to an aromatic ring, and/or D) a non-aromatic dicarboxylic acid or anhydride having a number average molecular weight of less than about 500.

10. The engine oil composition of claim 7, wherein the third dispersant is a reaction product of a A') hydrocarbyl-dicarboxylic acid or anhydride, and B') at least one polyamine that is post-treated with a non-aromatic dicarboxylic acid or anhydride having a number average molecular weight of less than about 500.

11. The engine oil composition of claim 1, further comprising one or more of detergents, dispersants, friction modifiers, antioxidants, rust inhibitors, viscosity index improvers, emulsifiers, demulsifiers, corrosion inhibitors, antiwear agents, metal dihydrocarbyl dithiophosphates, ash-free amine phosphate salts, antifoam agents, and pour point depressants and any combination thereof.

12. The engine oil composition of claim 1, comprising at least 1.5% soot.

13. The composition of claim 12, comprising from about 2% to about 3% soot.

14. The engine oil composition of claim 1, wherein the engine oil composition has a Noack volatility of less than 15 mass %.

15. The engine oil composition of claim 1, wherein the engine oil composition has a Noack volatility of less than 13 mass %.

16. A method for lubricating an engine comprising lubricating an engine with a engine oil composition as claimed in claim 1.

17. A method for maintaining the soot or sludge handling capability of an engine oil composition comprising the step of adding to the engine oil composition an additive composition comprising:

(a) at least 0.05 percent by weight, based on a total weight of the engine oil composition, of a first dispersant that is a reaction product of A) a hydrocarbyl-dicarboxylic acid or anhydride, and B) at least one polyamine; and (b) at least 0.05 percent by weight, based on a total weight of the engine oil composition, of a second dispersant that is a reaction product of A') a hydrocarbyl-dicarboxylic acid or anhydride, and B') at least one polyamine that is post-treated with C) an aromatic carboxylic acid, an aromatic polycarboxylic acid, or an aromatic anhydride wherein all carboxylic acid or anhydride groups are attached directly to an aromatic ring, and D) a non-aromatic dicarboxylic acid or anhydride having a number average molecular weight of less than about 500 reaction product of the second dispersant has a ration of A' to B' in the range of 4:3 to 2:1.

* * * * *